United States Patent [19]

Greenberger

[11] Patent Number: 4,509,279

[45] Date of Patent: Apr. 9, 1985

[54] INTERCHANGEABLE DIGITAL DISPLAY SIGN

[75] Inventor: William Greenberger, White Plains, N.Y.

[73] Assignee: The Hopp Press, New York, N.Y.

[21] Appl. No.: 457,526

[22] Filed: Jan. 13, 1983

[51] Int. Cl.[3] ..... G09F 3/04

[52] U.S. Cl. ..... 40/447; 40/450; 40/492

[58] Field of Search ..... 40/450, 447, 446, 492, 40/493, 530, 534, 535, 579, 580, 583, 124.4; 116/302, 303, 304, 306, 309, 313, 315, 316, DIG. 3, DIG. 16, DIG. 14, DIG. 23, DIG. 37

[56] References Cited

U.S. PATENT DOCUMENTS 4,137,650 2/1979 Hays ..... 40/534
4,164,824 8/1979 Nidelkoff ..... 40/488
4,220,948 9/1980 Trame ..... 40/450
4,313,270 2/1982 Volkert et al. ..... 40/124.1

FOREIGN PATENT DOCUMENTS 25082 9/1919 Denmark ..... 40/447
0031033 7/1981 European Pat. Off. ..... 40/450

*Primary Examiner*—Gene Mancene
*Assistant Examiner*—James R. Hakomaki
*Attorney, Agent, or Firm*—Kane, Dalsimer, Kane, Sullivan & Kurucz

[57] ABSTRACT

This invention relates to a display device that may be constructed from a single sheet of resilient material having a plurality of color contrasting portions that may be displayed in various combinations to form a desired character, e.g. numeral, or the like.

5 Claims, 17 Drawing Figures

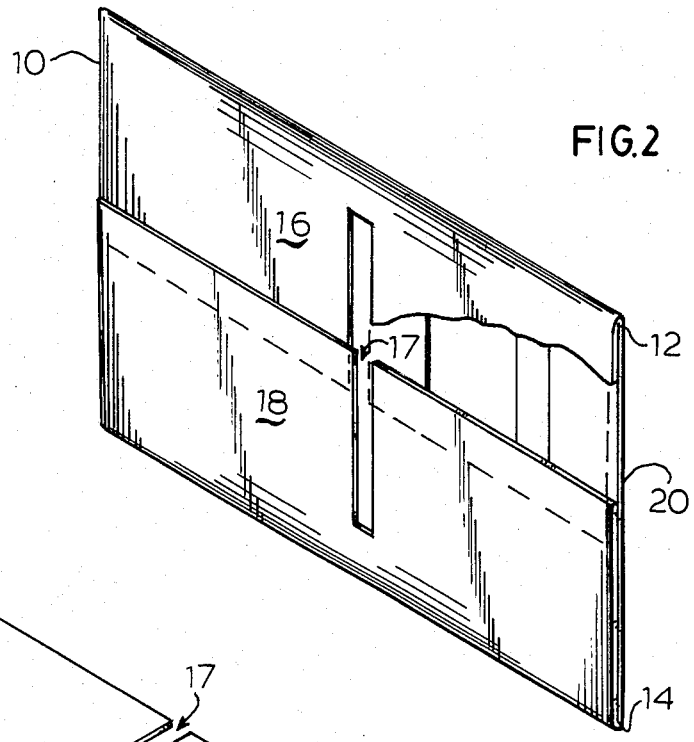
FIG. 2
FIG. 3
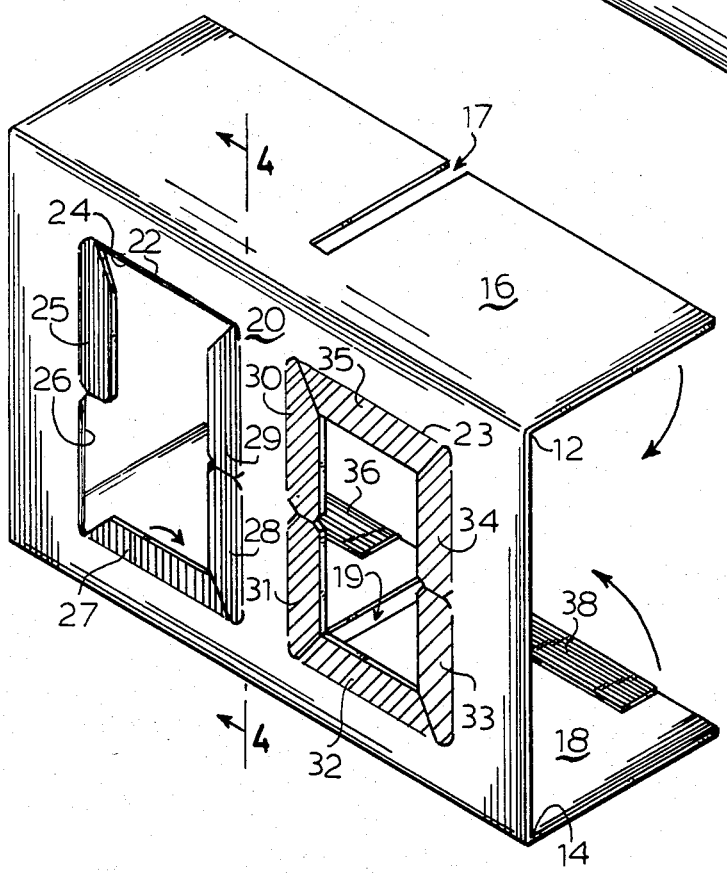
FIG. 4
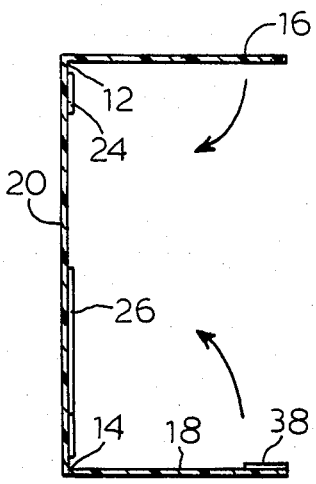

INTERCHANGEABLE DIGITAL DISPLAY SIGN

BACKGROUND OF THE INVENTION

The field of this invention relates to message display signs and in particular, signs of integrated construction having changeable characters.

DESCRIPTION OF THE PRIOR ART

Signs having changeable characters are well known in the sign display arts. A typical example of such signs having discrete removable numbers that are temporarily mounted on the face of a sign structure is shown in FIG. 1. Such signs are particularly useful for displaying information that is subject to change, e.g. prices.

A disadvantage of these prior art signs is that they require a separate supply of characters necessary to replace existing characters when a change is made. These separate characters are expensive and must be safely stored. Attempts have been made to avoid these problems by providing sign structures having changeable self storing characters but known devices are complex structures that are difficult to manufacture and too expensive for many applications, for example see U.S. Pat. No. 4,164,824.

SUMMARY OF THE INVENTION

The present invention provides a display device comprising a sheet of resilient material provided with a plurality of flaps having color contrasting portions cut in the sheets that may be positioned so that they cooperate with each other as elements which form the image of, ie. display, a character selected from the range of possible characters that depends on the number, size and shape of the cooperating flaps and color contrasting portions provided on the particular sign face.

It is an object of the present invention to provide a display device for forming a sign face or portion thereof that has easily changeable characters.

It is a further object of the present invention to provide a display device that may be easily and inexpensively constructed from a single sheet of resilient material.

It is a further object of the present invention to provide an efficient and economical display device having changeable characters the elements of which form an integral part of the device.

With the above and other incidental objects and advantages in view as will more fully appear in the specification, the invention intended to be protected by Letters Patent consists of the features of construction, the parts and combinations thereof, and mode of operation or their equivalents as hereafter described or illustrated in the accompanying drawings.

BRIEF DESCRIPTION OF THE DRAWINGS

FIG. 2 is a perspective rear view of a folded display device constructed in accordance with the present invention having two changeable characters.

FIG. 3 is a perspective frontal view of the display device of FIG. 2 partially unfolded.

FIG. 4 is a cross sectional view of FIG. 3 taken along line 4—4.

DETAILED DESCRIPTION OF PREFERRED EMBODIMENTS

Figure 1:
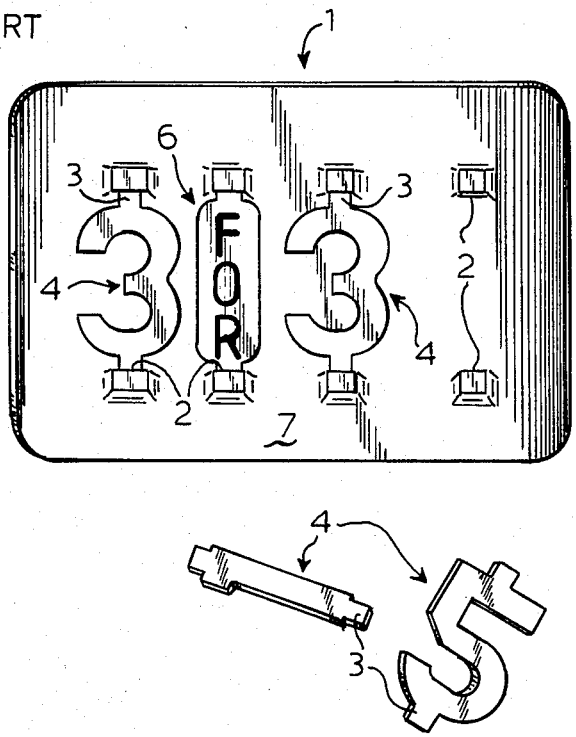
FIG.1 PRIOR ART
FIG. 1 is a perspective view of a prior art display device having changeable characters.

The prior art display device is illustrated in FIG. 1 for purposes of comparison with the present invention and it comprises a resilient sheet 1 forming sign face 7 having a plurality of small openings 2 therein for engaging tabs 3 located on the upper and lower portions of various characters 4.

Figure 5:
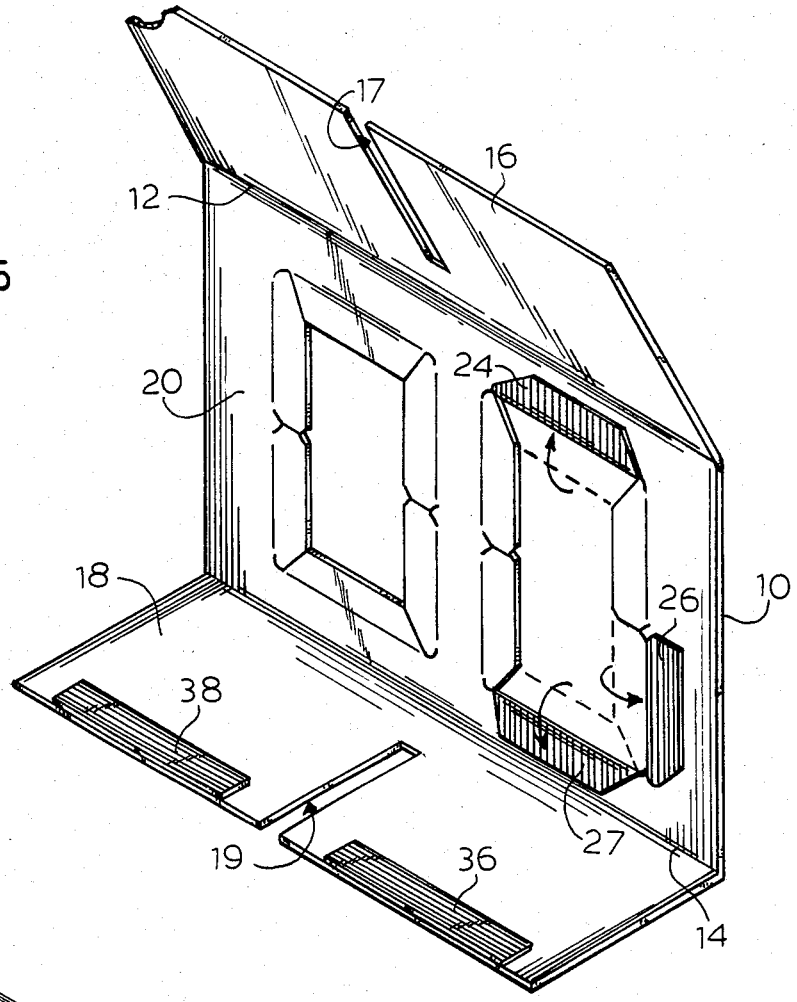
FIG. 5 is a perspective rear view of the display device of FIG. 2 partially unfolded.
Figure 6:
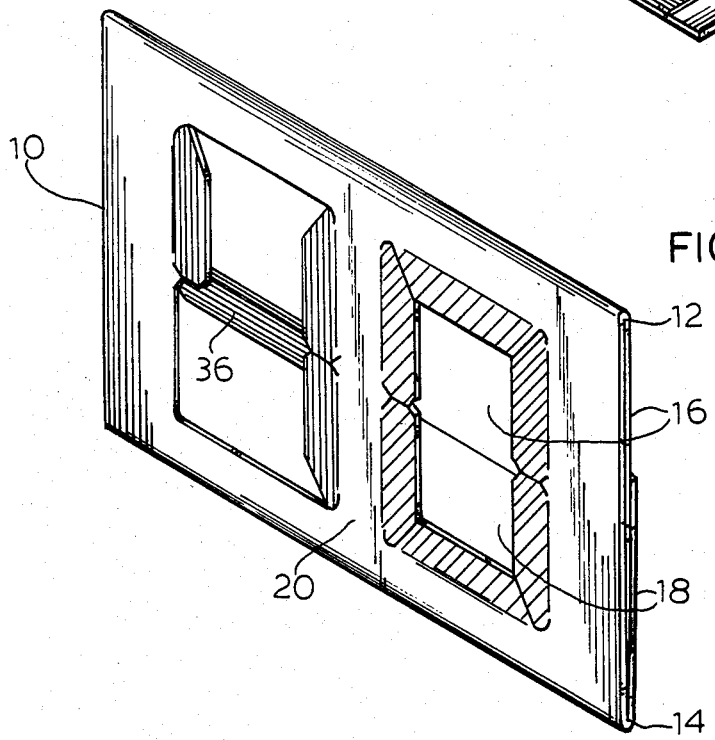
FIG. 6 is a frontal perspective view of the folded display device of FIG. 5.

The emodiment of the present invention illustrated in FIG. 2 comprises a resilient sheet 10 folded along creases 12 and 14 to form upper rear panel 16, lower rear panel 18, and display panel 20. The details of display panel 20 are better seen in FIG. 3. In this embodiment the display panel 20 is provided with two similar rectangular openings 22 and 23. Six similarly shaped color contrasting flaps are disposed about the periphery of each of the openings 22 and 23. These flaps are numbered 24 thru 35 for purposes of identification. Color contrasting portions for horizontal character elements 36 and 38 of substantially the same size and shape as the flaps 24 thru 35 and are provided on the inside face of lower rear panel 18 so that they may bisect the rectangular openings 22 and 23 when fully folded as hereinafter shown in FIG. 6. Each of the flaps 24 thru 35 have at least two stable positions. The first or 'out' position is such that the flap is extended into the corresponding opening and its color contrasting portion is displayed against the background provided by front panel 20 and the inside faces of rear panels 16 and 18. The second or 'in' position is such that the flap is folded inwardly, as best shown by flaps 24, 26 and 27, in FIGS. 5 and 6 so that they cannot be seen when the device is viewed from the front.

Figure 7:
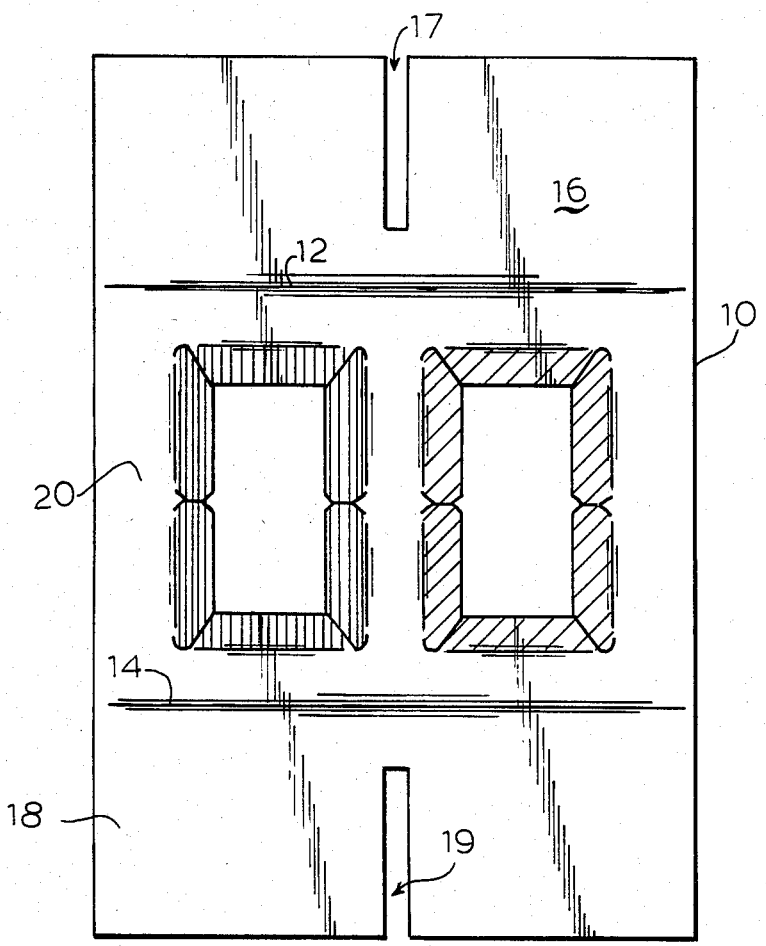
FIG. 7 is a top plan view of the display device of FIG. 2 unfolded.
Figure 8:
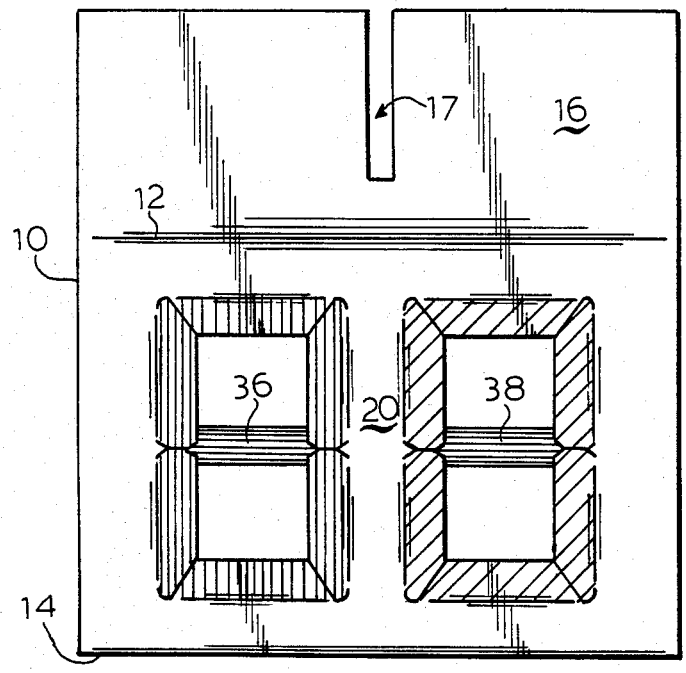
FIG. 8 is a top plan view of the display device of FIG. 7 partially folded.
Figure 9:
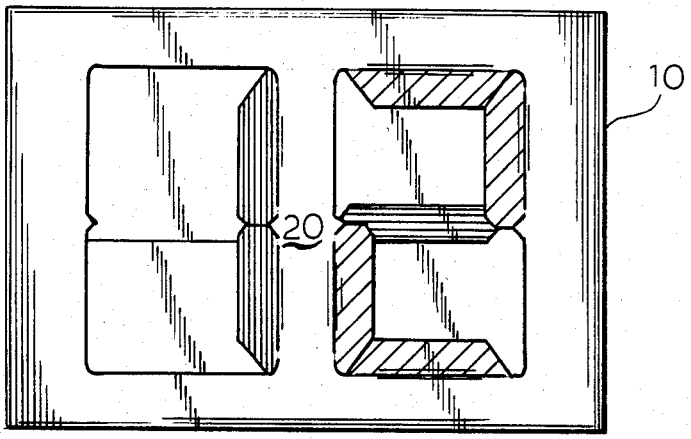
FIGS. 9 thru 14 are several perspective frontal views of the folded display device of FIG. 1 having various character configurations.
Figure 10:
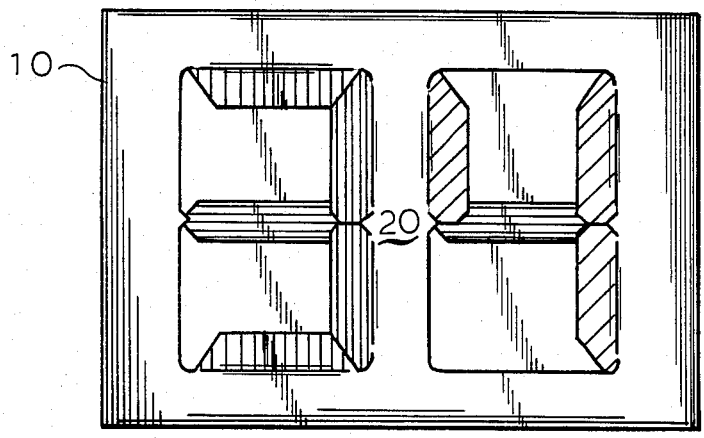
Figure 11:
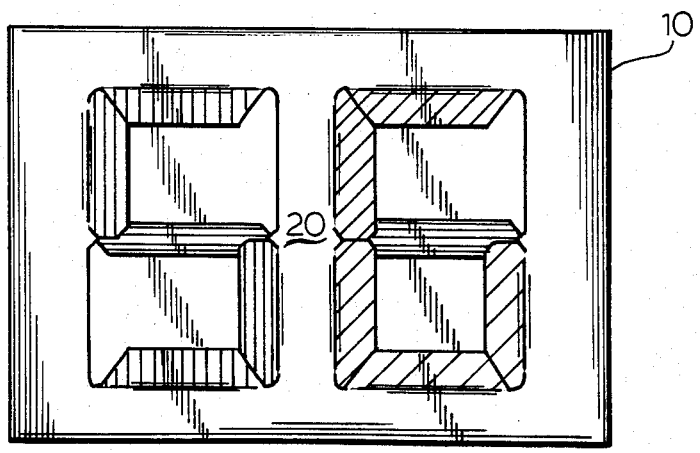
Figure 12:
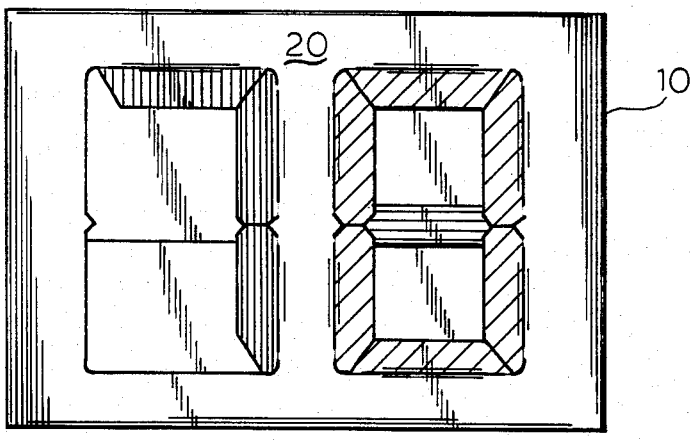
Figure 13:
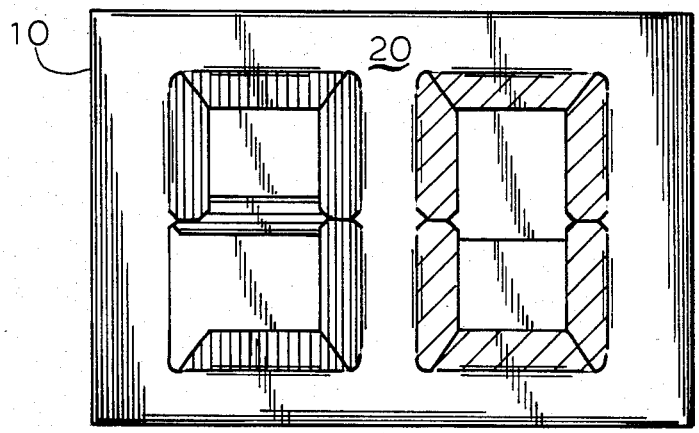
Figure 14:
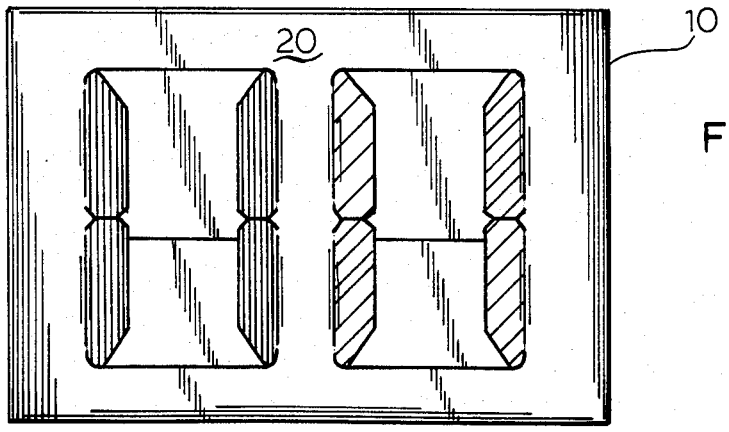

Slits 17 and 19 are provided in upper and lower rear panels 16 and 18, respectively. Slits 17 and 19 cooperate with horizontal character elements 36 and 38 so that the upper inside faces of upper and lower panels 16 and 18 may be positioned in the folded device 10 so that color contrasting portions 36 and 38 may be seen or unseen from the front as desired. For example, in FIG. 6 only element 36 is seen from the front while in FIG. 8 both elements 36 and 38 are seen. The simple construction of the embodiment of the present invention is illustrated by the top plan view of FIG. 7 this feature permits the cutting or stamping of a complete device from a single sheet of resilient material.

As shown by the drawings, particularly FIGS. 9 thru 14, the flaps 24 thru 35 and horizontal elements 36 and 38 may be positioned in the folded device 10 so that any number from 00 to 99 and some higher numbers, eg. 1111, may be displayed on the front panel 20.

Figure 15:
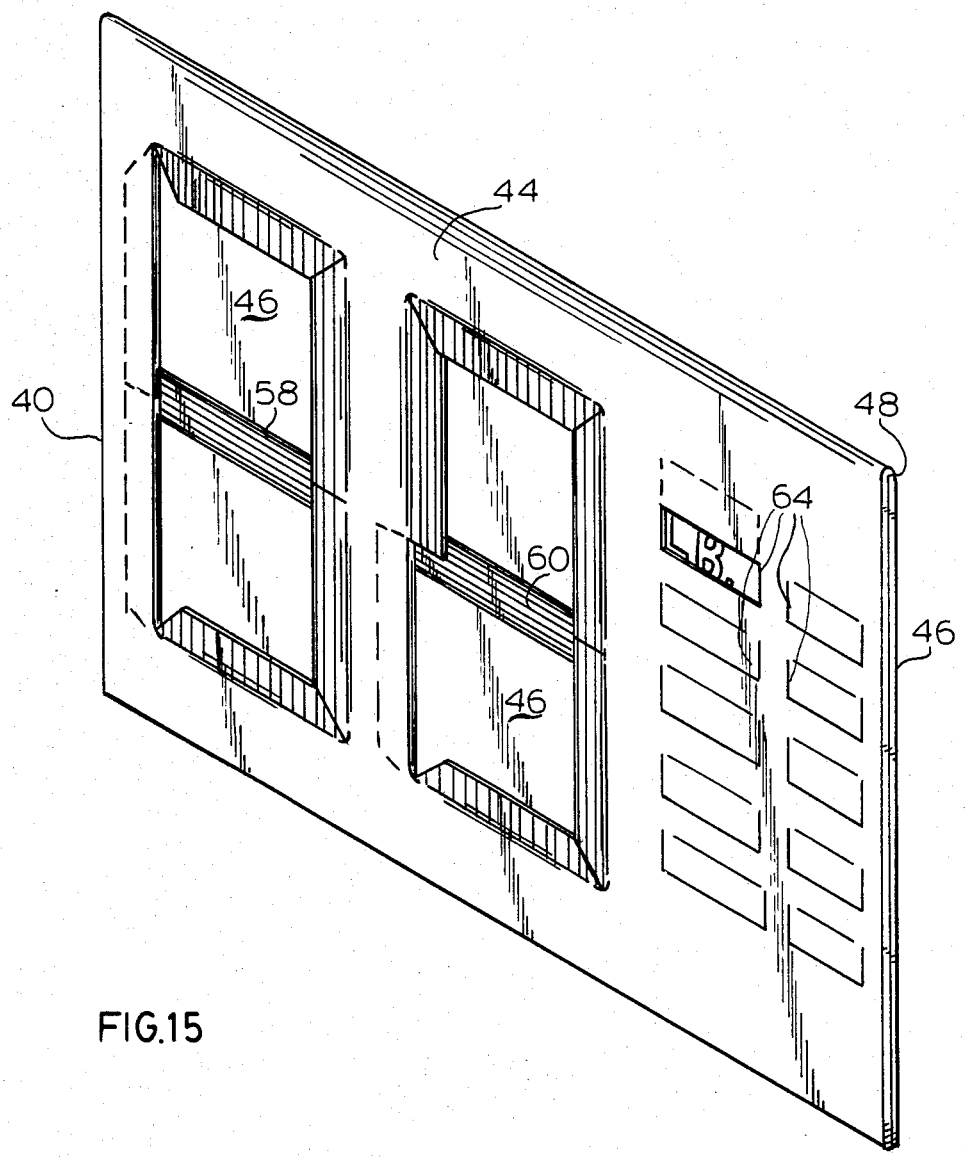
FIG. 15 is a perspective view of an alternate embodiment of the present invention.
Figure 16:
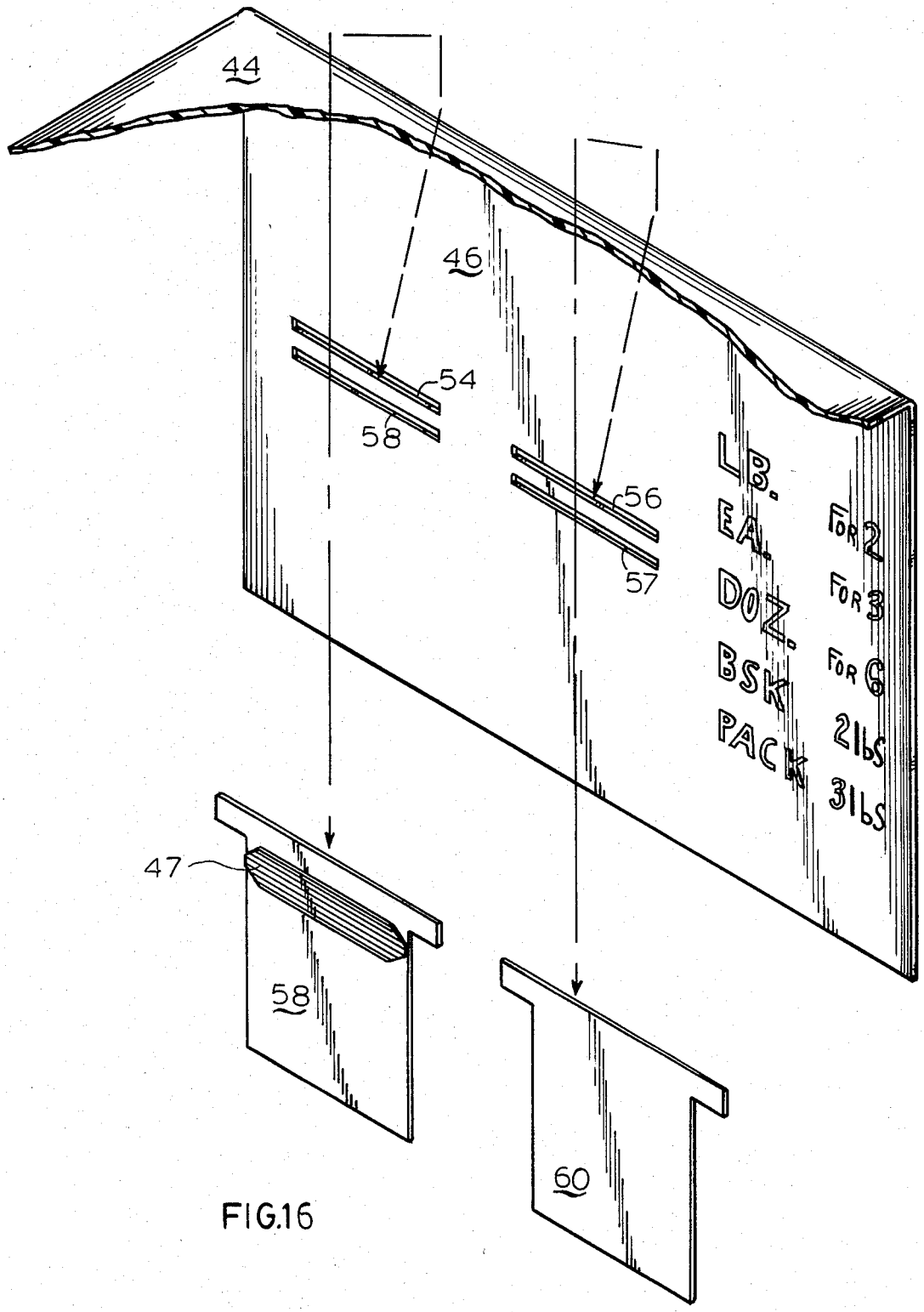
FIG. 16 is a fragmentary perspective view of a rear panel of an alternate embodiment display device having removable horizontal character elements.

FIGS. 15 and 16 illustrate an alternate embodiment of the present invention wherein the display device 40 is formed from a resilient sheet 42 folded into front and rear panels 44 and 46 respectively along crease 48. The front panel 44 is provided with two openings 50 and 52 having a plurality of color contrasting flaps disposed thereabout as described above. Slots 54, 55, 56 and 57 are provided in rear panel 46 so that they engage removable members 58 and 60. The removable members may be of the same color as the panels 44 and 46 and have a color contrasting portion forming horizontal character elements 47 about the same size and shape as the flaps, on at least one of their sides so that when they are engaged with corresponding slots the color contrasting portion 62 may be positioned to be seen bisecting the openings 50 and/or 52. This embodiment may further comprise information printed on the inside face of rear panel 46 so that when windows 64 provided in front panel 44 are folded back in the open position the information may be seen from the front of the folded device 40.

Figure 17:
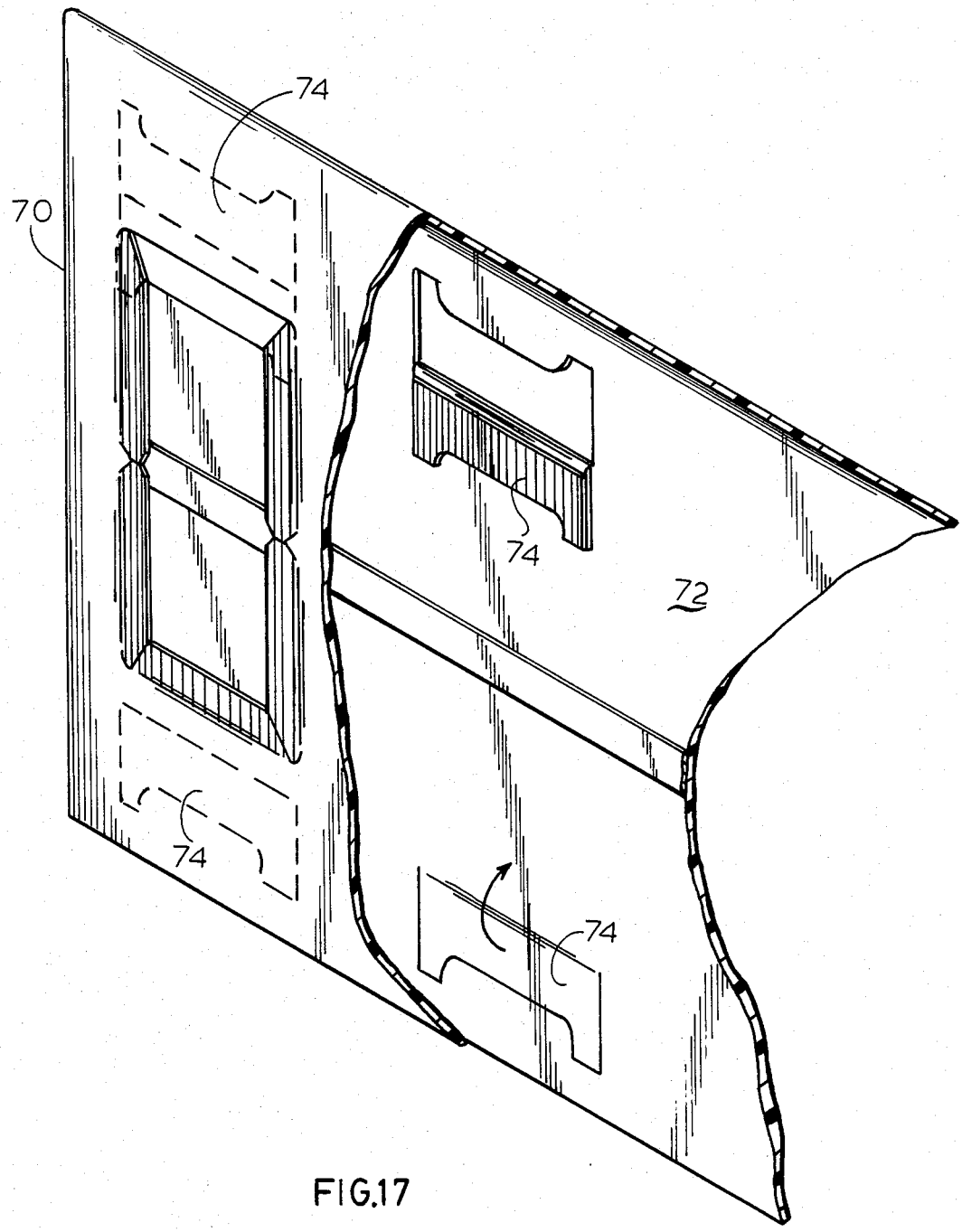
FIG. 17 is a fragmentary perspective view of an alternate embodiment display device having horizontal character elements cut in the rear panel.

FIG. 17 illustrates an alternate embodiment of the present invention 70 having a folded two panel construction wherein the rear panel 72 is provided with color contrasting flaps 74 cut therein that may be folded inwardly to form the upper and lower horizontal elements of characters to be displayed by the deivce.

From the above description, it will be apparent that there is thus provided a device of the character described possessing the particular features and advantages described herein, but which obviously is susceptible of modification in its form, proportions, details of construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise the best of several modes of putting the invention into effect and the invention is therefore claimed in any of its forms or modifications within the legitimate and valid scope of the appended claims.

What is claimed is:

1. A sheet, constructed of a single resilient plastic piece, having a face with at leat one opening therein and having a plurality of flaps with color contrasting portions thereon, the flaps being disposed about the periphery of said openings; and a first rear panel having color contrasting portions thereon and extending from a bottom portion of the face and being pivotable thereabout, the first rear panel being adapted to fold against a back of the face, forming a pocket between the face and the first rear panel, wherein the color contrasting portions of the flaps and the rear panel are adapted to cooperate with each other to display one of a number of possible characters, the color contrasting portions of the first rear panel being visible through the opening in the face.

2. The display device recited in claim 1 wherein:

the opening is substantially rectangular having two flaps disposed along two of its opposing sides and one flap along each of its remaining sides; and further comprising a first rear panel provided with a color contrasting portion that may be positioned so that it cooperates with the other color contrasting portions in displaying characters.

3. The display device recited in claim 2, further comprising:

a second rear panel extending from a top portion of the face and pivotable thereabout, so that when folded it provides an uninterrupted background for the opening.

4. The display device recited in claim 3 wherein:

at least one of the rear panels is provided with a slot so that a first side of the first rear panel may be displayed while a second side is hidden from view.

5. The display device recited in claim 1, 5, 3 or 4 wherein:

the color contrasting portions may be arranged in various configurations to form any desired numeral between 0 and 9 inclusive.

* * * * *

UNITED STATES PATENT AND TRADEMARK OFFICE

CERTIFICATE OF CORRECTION

PATENT NO. : 4,509,279

DATED : April 9, 1985

INVENTOR(S) : William Greenberger

It is certified that error appears in the above-identified patent and that said Letters Patent is hereby corrected as shown below:

In claim 5, line 1, after "1" change "5" to -- 2 --.

Signed and Sealed this

*Twenty-seventh* Day of *August 1985*

[SEAL]

*Attest:*

DONALD J. QUIGG

*Attesting Officer* *Acting Commissioner of Patents and Trademarks*